United States Patent [19]

Reist

[11] Patent Number: 5,012,988

[45] Date of Patent: May 7, 1991

[54] METHOD OF, AND APPARATUS FOR, PROCESSING PRINTED PRODUCTS, PERIODICALS AND THE LIKE

[75] Inventor: Walter Reist, Hinwil, Switzerland

[73] Assignee: Ferag AG, Hinwil, Switzerland

[21] Appl. No.: 388,305

[22] Filed: Jul. 28, 1989

Related U.S. Application Data

[63] Continuation of Ser. No. 42,329, Apr. 24, 1987, abandoned.

[30] Foreign Application Priority Data

Apr. 28, 1986 [CH] Switzerland ..... 1 731/86

[51] Int. Cl.[5] ..... B65H 19/30

[52] U.S. Cl. ..... 242/59

[58] Field of Search ..... 242/58, 59, 68.4, 67.1 R, 242/79, 58.6

[56] References Cited

U.S. PATENT DOCUMENTS

| | | | |
|---|---|---|---|
| 2,508,566 | 5/1970 | Dunton . | |
| 3,360,209 | 12/1967 | De Rocki | 242/58 |
| 3,586,253 | 6/1971 | Gilbank et al. . | |
| 3,935,888 | 2/1976 | Hornig | 242/59 |
| 3,977,617 | 8/1976 | Salmon | 242/68.4 |
| 4,131,206 | 12/1978 | Kawada | 242/79 |
| 4,265,411 | 5/1981 | Fasolak | 242/68.4 |
| 4,438,618 | 3/1984 | Honegger | 242/59 |
| 4,458,851 | 7/1984 | Tokuno | 242/68.4 |
| 4,641,795 | 2/1987 | Honegger | 242/59 |
| 4,925,120 | 5/1990 | Meier | 242/59 |

FOREIGN PATENT DOCUMENTS

| | | |
|---|---|---|
| 3104494 | 11/1982 | Fed. Rep. of Germany . |
| 0559691 | 3/1975 | Switzerland . |
| 2093439 | 9/1982 | United Kingdom . |
| 2119769 | 11/1983 | United Kingdom . |

*Primary Examiner*—Katherine Matecki

*Attorney, Agent, or Firm*—Fleit, Jacobson, Cohn, Price, Holman & Stern

[57] ABSTRACT

Printed products arriving in an imbricated formation are wound on a hollow cylindrical winding core together with a winding band in a wind-up station. A magazine or storage unit for the finished wound product packages is arranged in the vicinity of the wind-up station. After a wound product package has been fully wound up, it is rolled out of the wind-up station into the magazine or storage unit. A pallet is located in this magazine or storage unit onto which the finished wound product package is rolled. This pallet is displaced substantially perpendicular to the rolling direction of the finished wound product package. In this way, a plurality of wound product packages are arranged adjacent one another, typically in side by side relationship on one pallet. Blocking elements prevent the finished wound product packages from rolling off the pallet. By rolling the finished wound product packages out of the wind-up station to the adjacent magazine or storage unit there is afforded the possibility of emptying the wind-up station in a very short period of time without considerable effort and to prepare the wind-up station for receiving a new winding core.

8 Claims, 5 Drawing Sheets

METHOD OF, AND APPARATUS FOR, PROCESSING PRINTED PRODUCTS, PERIODICALS AND THE LIKE

This application is a continuation of application Ser. No. 07/042,329, filed Apr. 24, 1987, now abandoned.

CROSS-REFERENCE TO RELATED APPLICATION

This application is related to the commonly assigned, co-pending U.S. Pat. application Ser. No. 07/042,343, filed Apr. 24, 1987, entitled "METHOD OF, AND APPARATUS FOR, PROCESSING PRINTED PRODUCTS ARRIVING IN AN IMBRICATED FORMATION, ESPECIALLY NEWSPAPERS, PERIODICALS AND THE LIKE".

BACKGROUND OF THE INVENTION

The present invention relates to a new and improved method of, and apparatus for, processing printed products, especially newspapers, periodicals and the like.

In its more particular aspects, the present invention concerns a new and improved method of processing printed products, especially newspapers, periodicals and the like, arriving or delivered in an imbricated formation, wherein the imbricated product formation is wound onto a hollow substantially cylindrical winding core together with a tensioned winding band or strap. During the winding or wind-up operation each product is wound with one of the flat sides thereof in confronting relation to and upon the hollow substantially cylindrical winding core which rotates about an essentially horizontal axis and wherein the full or finished wound product packages are subsequently rolled away.

According to the present invention there is also taught a new and improved method of processing imbricated printed products, especially newspapers, periodicals and the like, which have been wound together with a winding band or strap onto a hollow substantially cylindrical winding core to form a wound product package and from which the printed products are unwound together with the winding strap.

The invention also is concerned in its more specific aspects with an apparatus for processing printed products, such as newspapers, periodicals and the like arriving in an imbricated formation, wherein there is provided a drive unit defining a product wind-up station or location and serving for the mounting and driving of a hollow substantially cylindrical winding core having a lengthwise axis which extends essentially in horizontal direction. There is also provided an infeed device or infeed means for the infeed or delivery of the imbricated product formation to the wind-up station or location and which is to be wound up upon the hollow substantially cylindrical winding core. There is further provided a support or mounting device for a supply spool or reel containing a winding band or strap which can be connected with the winding core as well as a roll track or travel surface means for the rolling away or outfeed of the finished wound product package.

As a further apparatus aspect of the present invention there is provided an apparatus for processing printed products, such as newspapers, periodicals and the like wound in an imbricated formation and together with a winding band onto a hollow substantially cylindrical winding core. There is provided a support or mounting unit which defines a wind-off or unwinding station or location for the mounting or support of the wound product package with its lengthwise axis extending substantially horizontally. There is also provided a drive unit for mounting and driving a take-up or receiving spool for the winding band or strap which is unwound from the product package as well as an outfeed or delivery device for the outfeed of the imbricated product formation which has been wound-off of the wound product package in conjunction with the winding band.

It is known to the art to wind as many printed products as possible onto a winding core in order to avoid too frequent exchange of a full or finished wound product package against an empty winding core or, conversely, an empty winding core for a new wound product package in consideration of the present day conventional high operating speeds of modern rotary printing presses and their subsequently arranged processing equipment. Significant in this regard are Swiss Patent No. 559,691, granted Jan. 31, 1975 and Swiss Patent No. 642,602 and its cognate U.S. Pat. No. 4,438,618, granted Mar. 27, 1984. Wound product packages of this type have a considerable weight and volume and cannot, therefore, be easily manipulated.

In the aforementioned Swiss Patent No. 559,691 it has been proposed to provide the hollow cylindrical winding core with disk-shaped lateral plates or cheek plates, the diameter of which is greater than the diameter of the wound product package formed by the printed products. These lateral plates or cheek plates are designed as rolling rims or rings which enables the winding core to be rolled together with the printed products wound thereon. The fully wound winding cores are conveyed from the wind-up station directly to an intermediate storage, and these fully wound winding cores are rolled over at least a portion of their path along inclined surfaces or planes.

Because of the appreciable volume or size and the weight of the wound product packages removal thereof from the wind-up station requires a relatively considerable amount of time and work. Thus, after the completion of a fully wound product package there is required a certain amount of time to again prepare the wind-up station for accomplishing a subsequent product winding or wind-up operation by mounting an empty winding core. However, this time span is readily available since there is likewise required a certain time until a fully wound product package has been completed at a second wind-up station and it is necessary to again place into operation the first wind-up station.

Similar problems also prevail when unwinding the printed products from their wound product packages, in that a certain amount of time is required for inserting or setting-up a heavy fully or finished wound product package into the wind-off or unwinding station.

SUMMARY OF THE INVENTION

Therefore, with the foregoing in mind, it is a primary object of the present invention to provide a new and improved method of, and apparatus for, processing printed products, especially newspapers, periodicals and the like, in a manner which is not afflicted with the aforementioned drawbacks and limitations of the prior art heretofore discussed.

Another and more specific object of the present invention is directed to the provision of a new and improved method of, and apparatus for, processing printed products, in which a wind-up station is unloaded in a simple and rapid way and an unwinding station is loaded in an equally simple and rapid way.

Yet a further significant object of the present invention is directed to an improved method and apparatus for rapidly off-loading wound product packages from a wind-up station in a highly reliable, relatively quick and efficient manner while handling the wound products in a protective fashion.

Still another important object of the present invention is directed to an improved method and apparatus for rapidly on-loading wound product packages from a storage unit or magazine to an unwinding station in a highly reliable, relatively quick and efficient manner while handling the wound products in a protective fashion.

Another noteworthy object of the present invention relates to an improved apparatus for off-loading wound product packages from a product wind-up station into a storage device or magazine in an efficient and reliable fashion and from which the stored wound product packages can again be relatively quickly and reliably removed, and which off-loading apparatus and storage device is of relatively simple construction and design, quite economical to manufacture, extremely reliable in operation, not readily subject to breakdown and malfunction, and requires a minimum maintenance and servicing.

A further distinctive object of the present invention relates to an improved apparatus for reliably storing wound product packages at a storage device or magazine from which the wound product packages, when necessary, can be quickly and reliably again removed and loaded into a package unwinding station or location, and which apparatus is of relatively simple construction and design, quite economical to manufacture, extremely reliable in operation, not readily subject to breakdown and malfunction, and requires a minimum of maintenance and servicing.

Now in order to implement these and still further objects of the invention, which will become more readily apparent as the description proceeds, one aspect of the method of the present development is manifested by the features that, the finished wound product packages are successively rolled from the wind-up station or location to an adjacent magazine or storage unit which receives a plurality of individual wound product packages.

According to a further aspect of the method of the present development the wound product packages are successively rolled out of a magazine or storage unit receiving a number of the wound product packages and arranged neighboring an unwinding or wind-off station or location to such unwinding or wind-off station or location.

As alluded to above, the invention is not only concerned with the aforementioned method aspects but relates to a new and improved construction of apparatus for processing printed products arriving in imbricated formation at a wind-up station or location, wherein a magazine or storage device is arranged neighboring the wind-up station or location and which is operatively associated or connected by a roll track or package travel surface means or the like with the wind-up station or location.

According to a further apparatus aspect of the present development for handling already wound-up or wound product packages, the present invention contemplates arranging a magazine or storage device for the reception of a plurality of wound product packages in neighboring relationship to the unwinding or wind-off station or location, and wherein the magazine or storage device is operatively connected by a roll track or package travel surface means or the like with the unwinding or wind-off station.

If the fully or finished wound product packages are rolled out of the wind-up station or location and into an adjacent magazine or storage unit, the wind-up station is ready for receiving an empty winding core in a very short time interval after the completion of a wound product package. Therefore, the wind-up station or location is again ready for the formation of the next wound product package after a very short time interval. This rapid conversion operation is suitable for fabricating product packages of a relatively small diameter which are wound within a shorter amount of time than large product packages.

Similar considerations apply for the unwinding or wind-off station or location, since a prior wound product package can be rapidly rolled from the magazine or storage unit located adjacent to such unwinding station or location and can be easily prepared for being unwound.

The magazine or storage unit can be used as a buffer magazine or storage unit in that the wound product packages are rolled in at one end thereof and such wound product packages can then again be removed from the magazine or storage unit at the other end thereof by rolling away the previously stored wound product package.

In another embodiment of the invention the magazine or storage unit is provided with a support structure constructed as transport means or unit, preferably a pallet, upon which there can be arranged a plurality of individual wound product packages. The wound product packages together with the support structure can be transported from the wind-up station or location to an intermediate storage unit and from the latter to a wind-off or unwinding station or location. Of course, the transport of the wound product packages can be accomplished directly from the wind-up station or location to the wind-off or unwinding station or location, in other words without any intermediate storage of the wound product packages.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the structure of the winding apparatus, namely the product wind-up apparatus and the product wind-off or unwinding apparatus, for processing printed products and the related wound product package magazines or storage units have been illustrated therein as is needed to enable one skilled in the art to readily understand the underlying principles and concepts of this invention.

Figure 1:
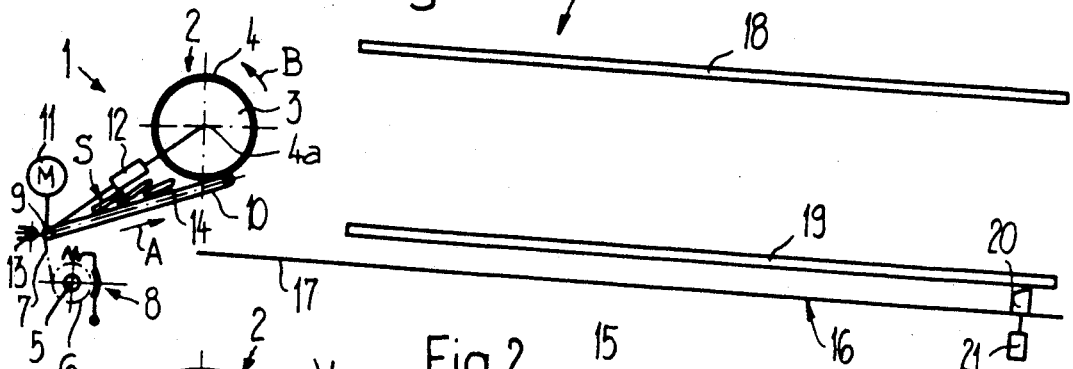
FIGS. 1 to 3 schematically illustrate a wind-up station in side view and respectively shown in different operational states.
Figure 2:
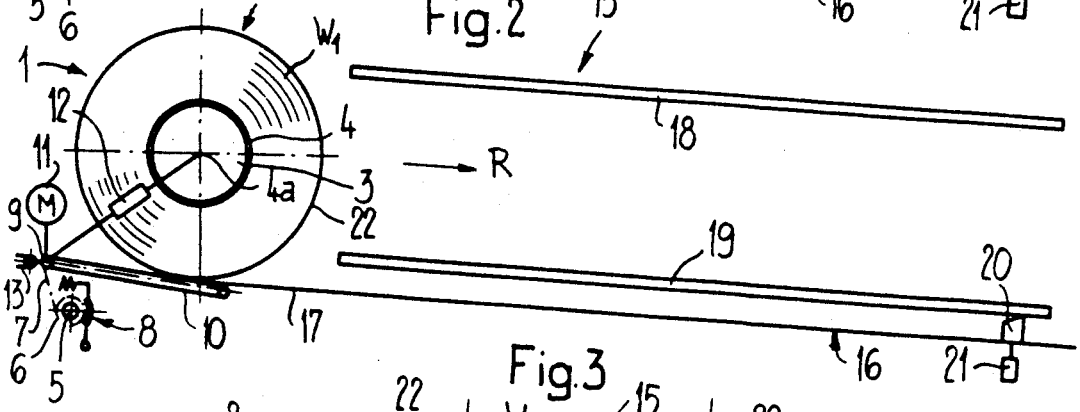
Figure 3:
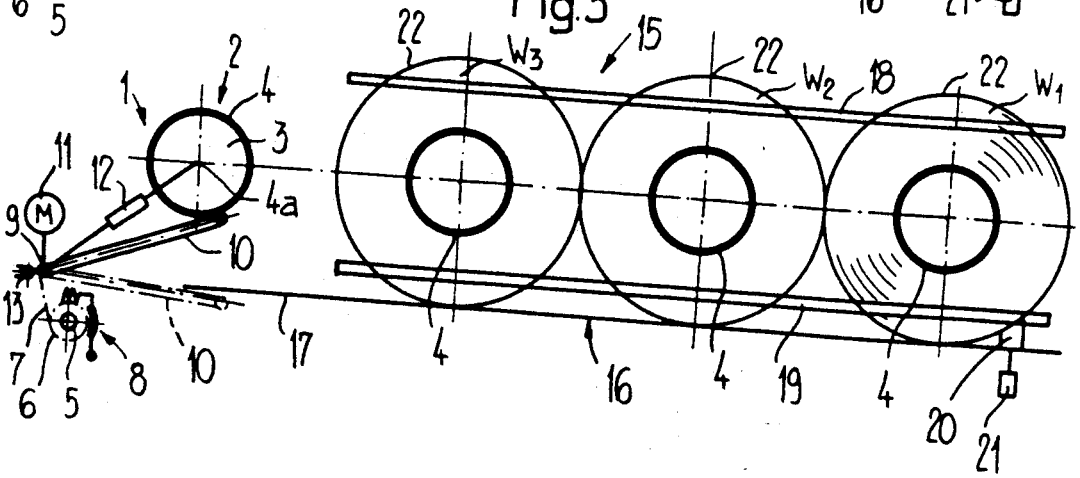

Turning now attention specifically to FIGS. 1 to 3 of the drawings, the product wind-up apparatus illustrated therein by way of example and not limitation will be seen to comprise a wind-up station 1 shown in three different operational states or working phases. This wind-up station 1 is provided with a mounting or support unit or arrangement 3 defining a wind-up position or location 2, whose construction has been shown in greater detail in FIGS. 7 and 8. This mounting unit or support arrangement 3 serves to rotatably support or mount hollow substantially cylindrical winding cores or mandrels 4, so that such can be rotatably driven about their associated lengthwise axis 4*a* which extends essentially in horizontal direction. Additionally, the wind-up station 1 is provided with a mounting or support unit or arrangement 5 for a supply spool or reel 6 for supplying a winding band or strap 7. A brake arrangement or brake means 8 is operatively associated with the supply spool or reel 6. The winding band 7 is guided around a driving or drive roll or roller 9 and extends along the upper side of a band or belt conveyor 10, constructed as a rocker or balance or balance arm, to the winding core or mandrel 4 with which there is connected the winding band or strap 7. The band conveyor 10 is pivotably supported or mounted about an axis substantially aligned with the rotational axis of the driving or drive roller 9. The driving or drive roller 9 and also the band conveyor 10 are driven by means of a suitable drive motor 11 which, through the intermediary of a winding transmission or gear unit 12, causes the winding core 4 to rotate in the direction of the arrow B depicted in Figure. Arranged forwardly or upstream of the band conveyor 10 is a suitable product infeed means or infeed device 13, which delivers the printed products 14 or the like to be processed in an imbricated formation S.

The wind-up station 1 further comprises a magazine or storage unit 15 located adjacent to the wind-up location or position 2. This magazine or storage unit 15 possesses a support structure or support means 16 for the finished or fully wound product packages, generally referred to by reference character W. This support structure or support means 16 merges with a rolling or roll track or package travel surface means 17 which extends to the region of the wind-up location or position 2. The magazine or storage unit 15 is further provided with lateral guides or guide members 18 and 19 for the wound product packages W. Under certain circumstances these lateral guides or guide means 18 and 19 can be omitted. In the terminal or rear end portion of the magazine or storage unit 15, as viewed in the rotational or rolling direction R of the wound product packages W, there are arranged blocking or locking devices or means 20 which can be released by means of a suitable drive means or actuator mechanism 21. By means of these blocking or locking devices 20 there is prevented any unintentionally rolling away of the wound product packages W.

The imbricated formation S infed by the product infeed device or means 13 is wound onto the winding core or mandrel 4 with a flat side or surface of the printed products 14 confronting the winding core or mandrel 4. This product wind-up operation is undertaken in conjunction with the winding band or strap which is under tension. The winding core 4 is driven by means of the drive motor 11 in the direction of the arrow B as shown in FIG. 1 in order to wind-up the incoming imbricated formation S of the printed products 14 together with the tensioned winding band or strap 7. This wind-up of the imbricated formation S of the printed products 14 onto the winding core 4 is performed basically in accordance with the procedures disclosed in the aforementioned Swiss Patent No. 642,602 and the cognate U.S. Pat. No. 4,438,618.

After completion of a wound product package, such as the wound product package $W_1$ as shown in FIG. 2, this wound product package $W_1$ is removed from the wind-up position or location 2 and rolled in the direction of the arrow R into the magazine or storage unit 15. During this procedure the wound product package $W_1$ is positioned with the printed products 14 of the outermost wound layer or coil, i.e. on its circumference 22, upon the roll track 17 and upon the support structure 16. The roll or rolling track 17 and support structure 16 are slightly downwardly inclined with respect to the horizontal plane, so that the wound product package $W_1$ can be removed from the winding position or location 2 very quickly and with minimum effort. The wound product package $W_1$ rolls up to the location of the blocking or locking means 20 which prevent any further rolling movement thereof.

As soon as the winding position or location 2 is free, a new winding core or mandrel 4 can be mounted and operatively connected with a new winding band or strap 7. Consequently, the wind-up station 1 is again ready for forming a new product package W.

Each time a wound product package W is finished, it is rolled from the wind-up position or location 2 into the magazine or storage unit 15 in the aforedescribed manner. This magazine or storage unit 15 is capable of accommodating a plurality of individual wound product packages W. In FIG. 3 there have been specifically depicted three such wound product packages, specifically indicated by reference character $W_1$, $W_2$ and $W_3$, located in this magazine or storage unit 15. This magazine or storage unit 15 functions as a buffer magazine or storage unit from which there can be removed at any desired time the wound product packages $W_1$, $W_2$ and $W_3$ and, for instance, transported to an intermediate storage or to an unwinding or wind-off station. For this purpose, the blocking or locking means 20 are released by the drive means or actuator mechanism 21, enabling a given wound product package, for instance the wound product package $W_1$, to roll out of the magazine or storage unit 15. The further transport of any given wound product package W removed from the magazine or storage unit 15 can be accomplished in any suitable fashion. While at one end of the magazine or storage unit 15 there are delivered thereto wound product packages, it is possible to remove at the other end of the magazine or storage unit 15 wound product packages. The wound product packages W, viewed in the package rolling direction R, are arranged behind one another or in tandem in the magazine or storage unit 15 and bear against one another at their outer or circumferential surface or circumference 22.

Since after completion of a fully or finished wound product package W such only must be rolled into the magazine or storage unit 15 arranged in neighboring relationship or adjacent to the wind-up position or location 2, this wind-up position or location 2 is ready in a very brief amount of time for the reception of an empty winding core or mandrel 4. There are not required any time-consuming and work-intensive operations or manipulations in order to remove a fully or finished wound product package W from the wind-up position or location 2. The rolling away of the fully wound or finished or completed wound product package W is not associated with any particular problems, since the wound product packages are not too great in size and not too heavy. Additionally, the wound product packages W are very compact so that there does not arise any appreciable or undesirable flattening of the wound product packages W which would render more difficult easy rolling away of such wound product packages W.

Figure 4:
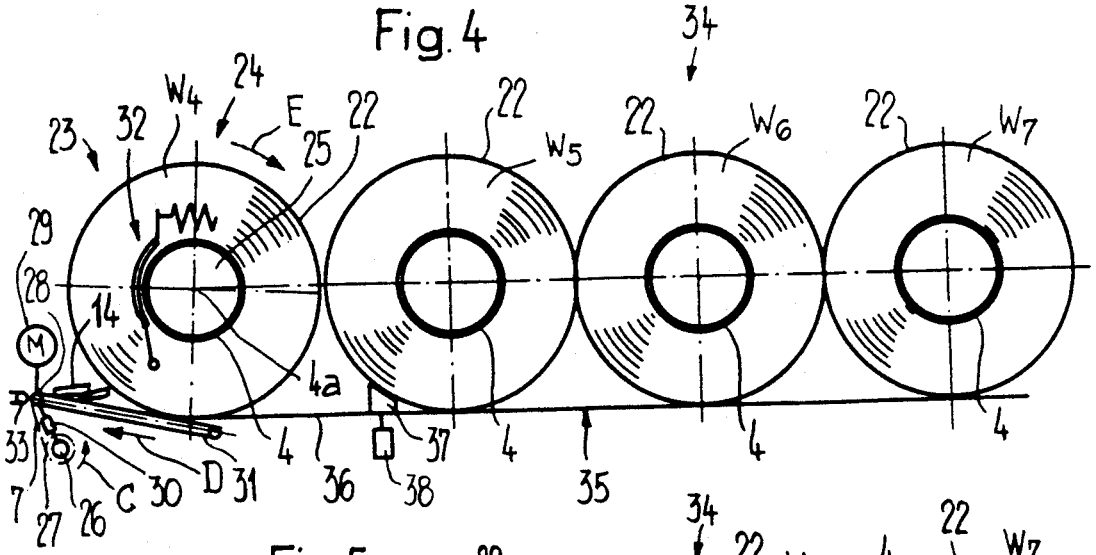
FIGS. 4 to 6 schematically illustrate an unwinding station in side view and respectively shown in different operational states.
Figure 5:
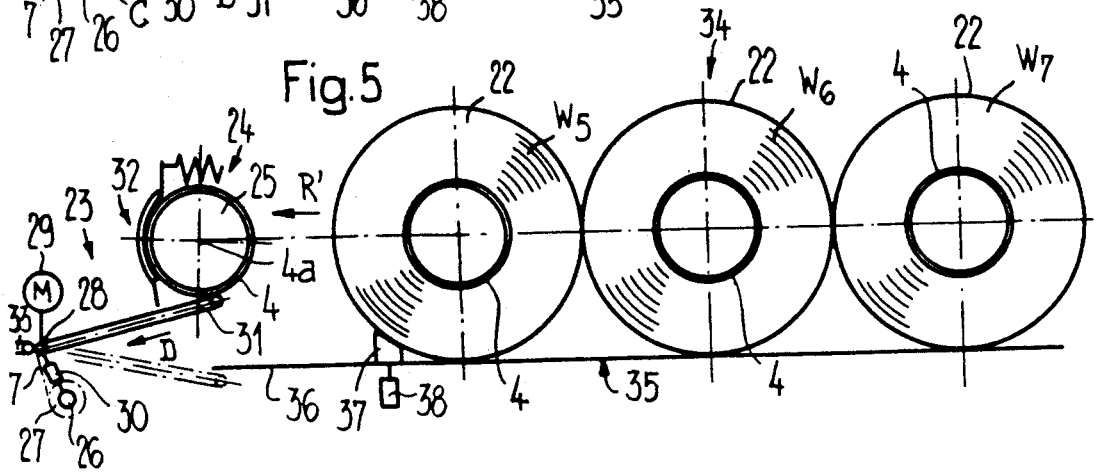
Figure 6:
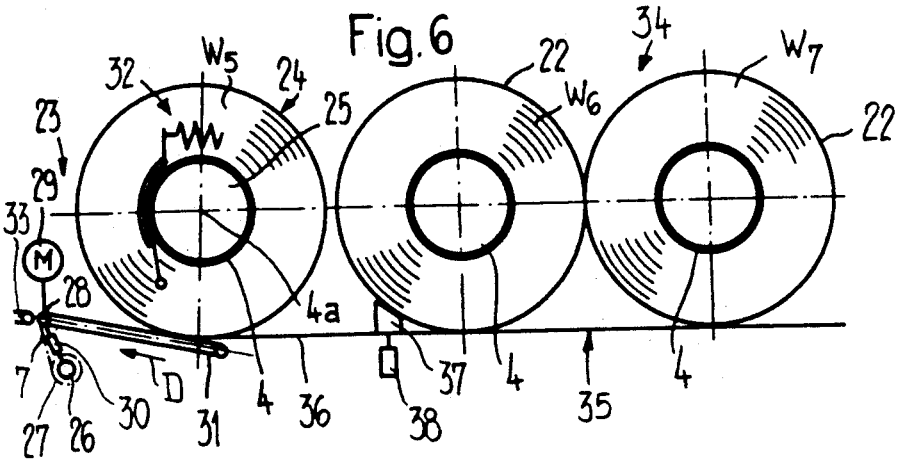

In FIGS. 4 to 6 there is now shown an unwinding or wind-off station 23 in different operational states or working phases. This unwinding station 23 is quite similar to the wind-up station 1 depicted in FIGS. 1 to 3 and possesses a mounting or support unit or arrangement 25 defining an unwinding position or location 24. This mounting or support unit 25 serves to rotatably support or mount the related wound product package W about an axis which extends essentially horizontally. Additionally, there is provided a mounting or support arrangement or unit 26 for the take-up or receiving spools or reels 27 for the winding band or strap 7. This winding band or strap 7 is guided over a driving or drive roll or roller 28 which is driven by a drive motor 29 which, by means of a winding transmission or gearing unit 30 rotates the take-up or receiving spool or reel 27 in the direction of the arrow C. Moreover, the drive motor 29 drives a band or belt conveyor 31 which is structured as a rocker or balance or balance arm and whose conveying direction has been generally indicated by reference character D in FIGS. 4 to 6. Additionally, there is provided a brake arrangement or brake unit 32 which is effective at the winding core or mandrel 4. The band conveyor 31 has arranged thereafter an outfeed device or delivery conveyor 33 or equivalent structure.

The winding band 7 together with the wound printed products 14 are unwound from the wound product package W upon driving the driving or drive roll or roller 28 and are removed by means of the band conveyor 31 and the outfeed or delivery device or conveyor 33. The wound-off winding band or strap 7 is wound onto the take-up or receiving spool or reel 27. The wound product package W which rotates in the direction of the arrow E, as shown in FIG. 4, is slightly braked by the action of the brake arrangement or brake unit 32. The winding-off or unwinding of the printed products 14 from the wound product packages W is performed essentially as disclosed in the aforementioned Swiss Patent No. 649,062 and the cognate U.S. Pat. No. 4,438,618 to which reference may be readily made.

A magazine or storage unit 34 is arranged neighboring or adjacent to the unwinding or wind-off position or location 24 and is constructed similar to the magazine or storage unit 15 shown in FIGS. 1 to 3. Thus, the magazine or storage unit 34 possesses a slightly descending support or support structure 35, which slopes towards the unwinding position or location 24, for supporting the wound product packages $W_5$, $W_6$ and $W_7$. This support structure 35 merges with a roll track 36 or equivalent structures which extends into the region of the unwinding position or location 24. At the magazine end neighboring the unwinding position or location 24 the magazine or storage unit 34 is equipped with a blocking or locking device 37, which can be actuated by means of a suitable drive or drive unit or actuator mechanism 38. The blocking or locking device 37 prevents any undesired rolling of the wound product packages W out of the magazine or storage unit 34.

As soon as all of the products of a wound product package, for example the wound product package $W_4$ (FIG. 4) have been unwound, the now empty winding core or mandrel 4 is removed out of the unwinding or wind-off position or location 24. The same applies for the take-up or receiving spool or reel 27 with the winding band or strap 7 wound thereupon. By releasing the blocking device or means 37 there now can be rolled the next wound product package $W_5$ out of the magazine or storage unit 34 to the unwinding position or location 24. In so doing, the wound product package $W_5$ bears at its outer surface or circumference 22 upon the support structure 35 and the roll track 36. After completion of the connection of the winding band 7 with a take-up or receiving spool or reel 27, there can be initiated the unwinding of the printed products 14 of the wound product package $W_5$. The remaining wound product packages $W_6$ and $W_7$ roll in the direction of the unwinding position or location 24, however are prevented from rolling out of the magazine or storage unit 34 by the action of the blocking or locking means 37.

By rolling new wound product packages W into the magazine or storage unit 34 from the end thereof situated opposite to the unwinding position or location 24, it is possible to continuously fill the magazine or storage unit 34 with fully wound product packages W.

Just as was the case for the wind-up station 1 described with reference to FIGS. 1 to 3, it is equally possible to very rapidly again prepare the unwinding station 23 for the unwinding or uncoiling of a new wound product package after all printed products 14 have been unwound from a prior processed wound product package. There are not required any lengthy handling or manipulation times for placement of a new wound product package W into the unwinding position or location 24.

In conjunction with the illustration of FIGS. 7 and 8 there will now be explained a possible construction of the mounting or support unit 3 of the wind-up station 1 in order to attain a rapid exchange of a fully or finished wound product package W by an empty winding core or mandrel 4.

This mounting or support unit 3 possesses two short shafts or stub shafts 39 and 40 which are mutually aligned in the direction of the axis 3*a* and terminate in spaced relationship from one another. These stub shafts 39 and 40 are rotatably mounted by ball or roller bearings 41 and 42 and support at one end a sprocket wheel or gear 43 which is driven by the drive motor 11 through the intermediary of the winder or winding transmission or gearing unit 12. Support or bearing sleeves 44 and 45 are seated upon these stub shafts 39 and 40, respectively, and the support or bearing sleeves 44 and 45 are displaceable in the direction of the arrow F. This displacement is rendered possible by wedge or key and keyway connections 46 and 47 or equivalent structure by means of which the support or bearing sleeves 44 and 45 are rigidly connected for rotation with the stub shafts 39 and 40, respectively. The displacement of the support or bearing sleeves 44 and 45 is accomplished by means of appropriate drives or drive units 48 and 49, respectively.

Figure 7:
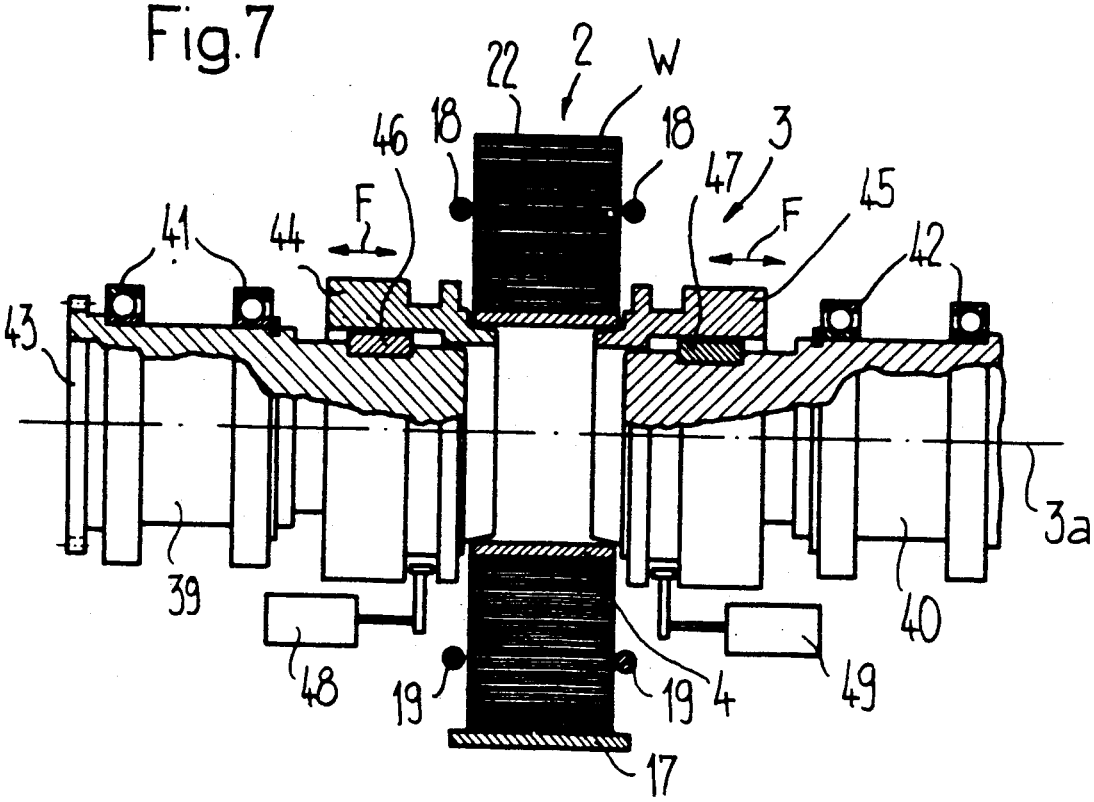
FIG. 7 schematically illustrates the drive and support unit of the wind-up station in side view and partially in sectional view depicting the wound product package in its mounted or supported state.

In FIG. 7 the support or bearing sleeves 44 and 45 are depicted in their engaged or moved-in position in which they engage with the inner surface or inner wall of a winding core or mandrel 4 and mount the latter. By retracting the support or bearing sleeves 44 and 45 into the position depicted in FIG. 8, these support or bearing sleeves 44 and 45 move out of engagement with such winding core or mandrel 4. This now renders it possible, in the manner described previously with respect to the embodiment of FIGS. 1 to 3, to roll the wound product package W bearing upon the roll or rolling track 17 out of the wind-up position or location 2. In so doing the wound product package W can be laterally guided by the guides or guide means 18 and 19 and thus prevented from toppling over.

Figure 8:
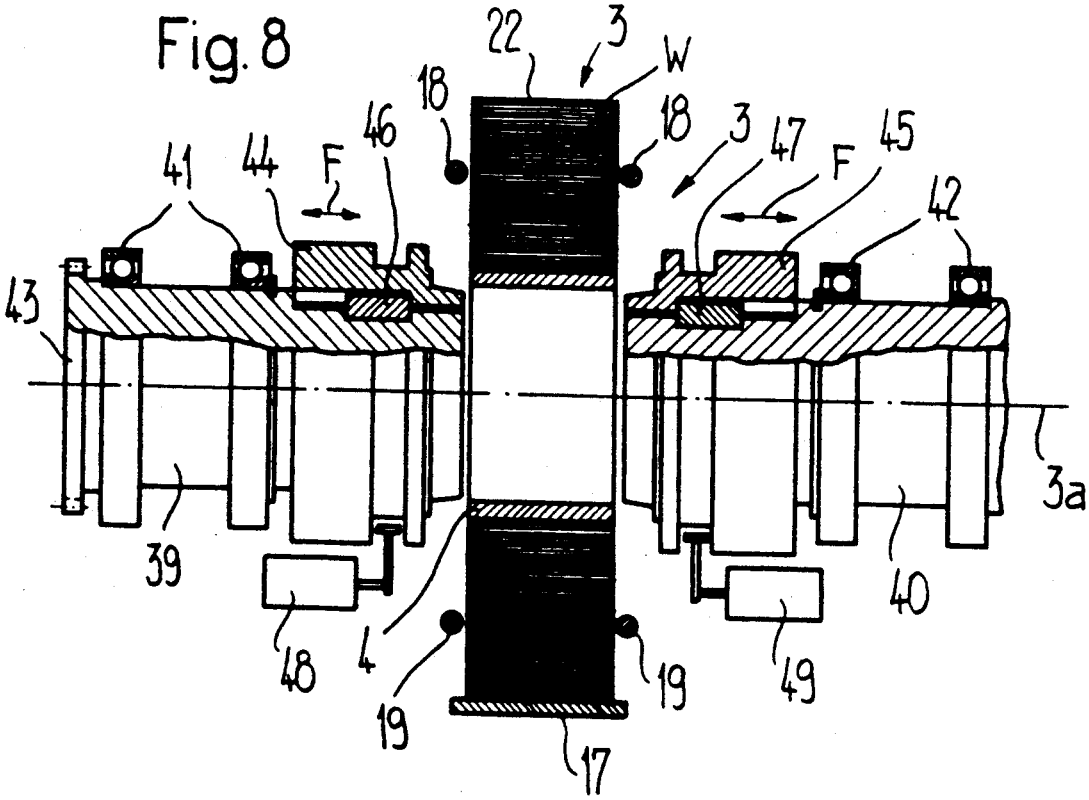
FIG. 8 schematically illustrates the drive and support unit of the wind-up station in side view and partially in sectional view similar to the showing of FIG. 7 but depicting the wound product package at the drive and support unit in a position ready to be removed therefrom.

It should be understood that the mounting or support unit for the unwinding station 23 can be constructed similar to the arrangement depicted in FIGS. 7 and 8.

Figure 9:
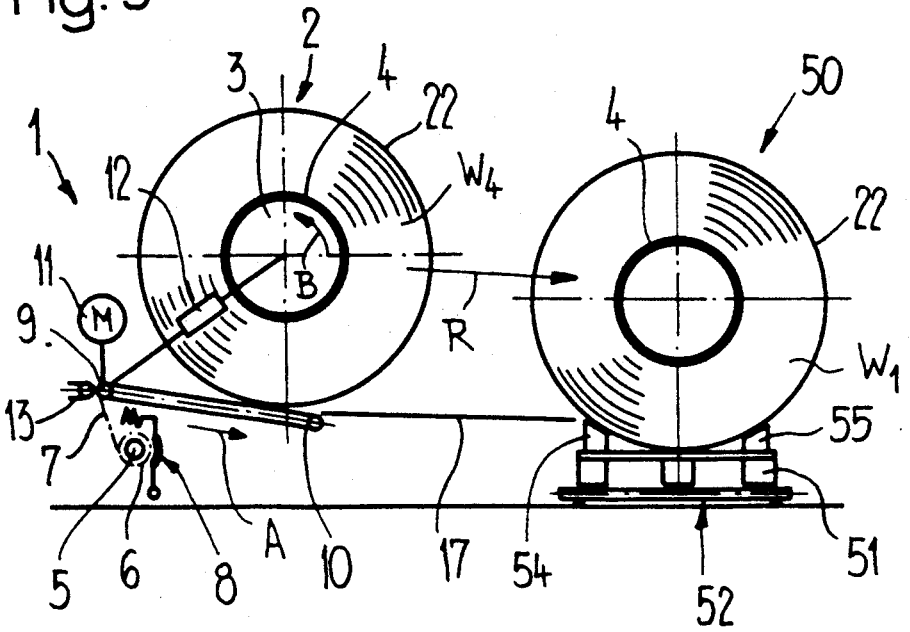
FIG. 9 schematically illustrates a second embodiment of a wind-up station in side view.
Figure 10:
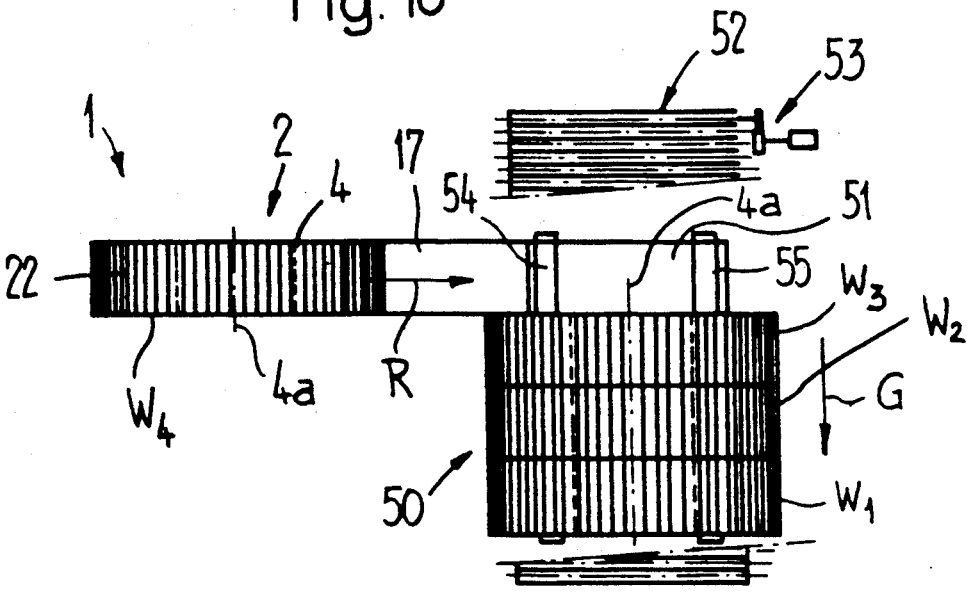
FIG. 10 schematically illustrates the wind-up station shown in FIG. 9 but depicted in top plan view.

In FIGS. 9 and 10 there is now illustrated a variant embodiment of the wind-up station 1. This variant embodiment differs from the embodiment depicted in FIGS. 1 to 3 by virtue of a different construction of the magazine or storage unit 50 arranged neighboring the wind-up position or location 2. This magazine or storage unit 50 comprises a pallet 51 or equivalent structure which bears upon a roller track 52. Reference character 53 designates the drive or drive means for the roller track 52. This roller track 52 has a conveying direction G which extends approximately perpendicular to the out-roll direction R of the finished or fully wound product packages W. The wind-up position or location 2 is operatively connected with the pallet 51 by means of the slightly inclined roll or rolling track 17 or equivalent structure.

Fully or finished wound product packages W are rolled away, in the manner described previously with reference to FIGS. 1 to 3, out of the wind-up position or location 2 in the direction of the arrow R and arrive by means of the roll track 17 at the pallet 51 where they come to bear at their outer surface or circumference 22. By means of the arresting or stop elements 54 and 55 the wound product packages W are prevented from rolling off of the associated pallet 51.

After a fully or finished wound product package W has been rolled onto the pallet 51, the latter is advanced in the direction of arrow G. The next wound product package, for instance the wound product package $W_4$, now comes to lie adjacent the previously fabricated package, for instance the wound product package $W_3$. The substantially similar size wound product packages $W_1$, $W_2$, $W_3$ and $W_4$ are now arranged adjacent one another with their flat sides or ends confronting one another, so that the lengthwise axes 4*a* of the winding cores or mandrels 4 of the wound product packages located upon the pallet 51 are in alignment with one another.

For removing the wound product packages W from the pallet 51 a conventional loading means or device can be used. In contrast to the embodiment shown in FIGS. 1 to 3 the finished wound product packages $W_1$, $W_2$, $W_3$ and $W_4$ are not individually removed from the magazine or storage unit 50, but collectively handled as a transport unit consisting of a plurality of wound product packages.

Figure 11:
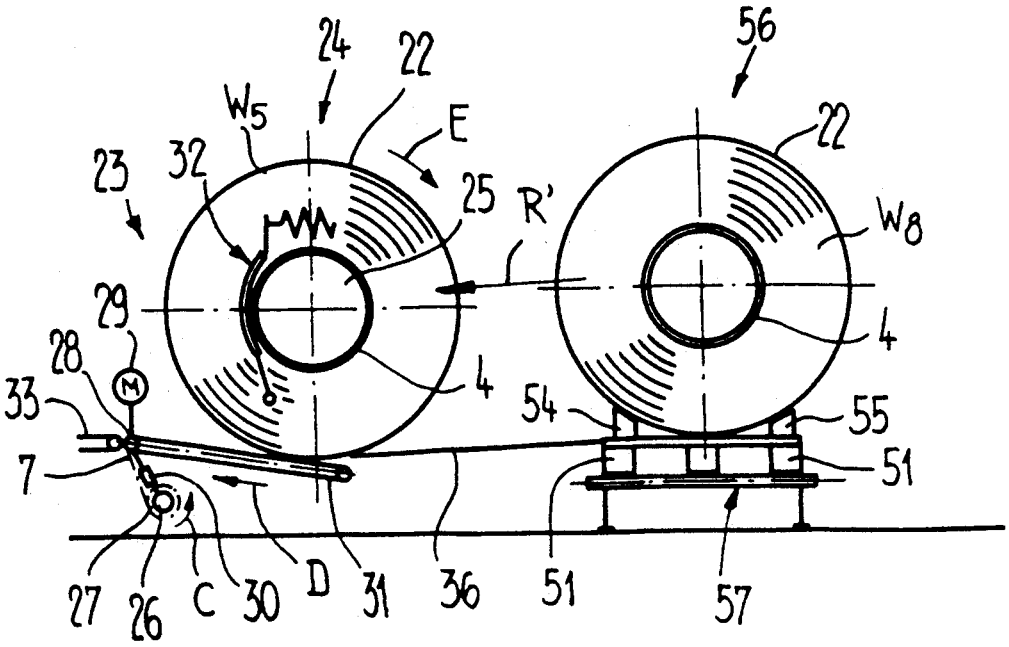
FIG. 11 schematically illustrates a second embodiment of an unwinding station in side view.
Figure 12:
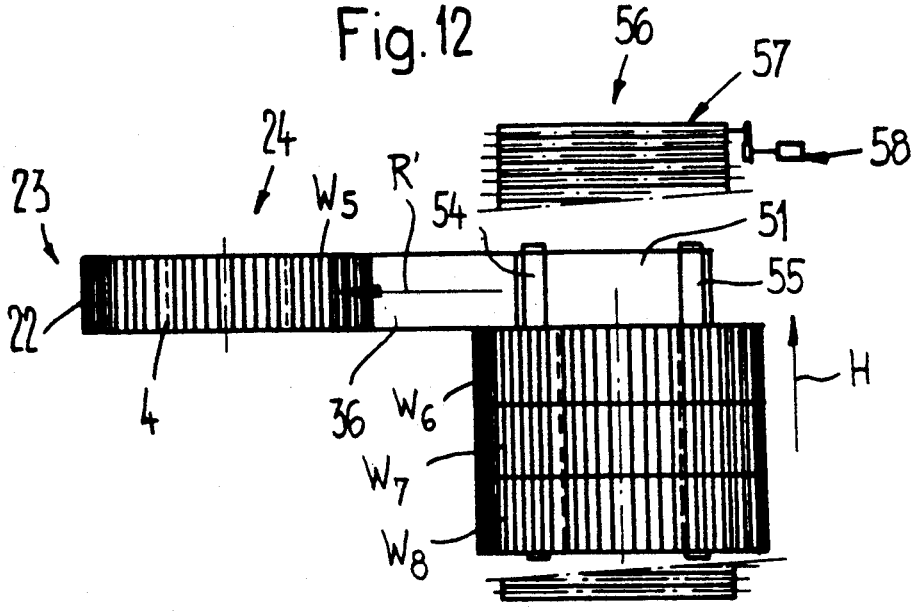
FIG. 12 schematically illustrates the unwinding station of FIG. 11 in top plan view.

After an optional intermediate storage these transport units are introduced into a magazine or storage unit 56 of an unwinding or wind-off station 23, as such has been shown in FIGS. 11 and 12. With the exception of the construction of the magazine or storage unit 56 this unwinding station 23 corresponds to the embodiment depicted in FIGS. 4 to 6.

The pallet 51 together with the wound product packages $W_5$, $W_6$, $W_7$ and $W_8$ which are to be emptied are deposited upon a part of the roller track 57 forming the magazine or storage unit 56, and this roller track 57 can be driven by means of a suitable drive or drive unit 58. The conveying direction of the roller track 56 has been designated by reference character H in FIG. 12.

The wound product packages W are rolled from the pallet 51 by means of the roll or roller track 36 or equivalent structure in the direction of the arrow R' towards the unwinding position or location 24 as such has been previously explained in detail in conjunction with FIGS. 4 to 6. The pallet 51 is successively advanced or fed in the direction of the arrow H in order to bring the wound product packages successively into a position which is in alignment with the roll or rolling track 36.

While there are shown and described present preferred embodiments of the invention, it is to be distinctly understood that the invention is not limited thereto, but may be otherwise variously embodied and practiced within the scope of the following claims. accordingly,

What I claim is:

1. A method of processing printed products arriving in an imbricated formation, especially newspapers, periodicals, and the like, comprising the steps of:

rotating a hollow substantially cylindrical winding core about an essentially horizontal axis of rotation and upon which there is to be wound the imbricated formation of printed products at a winding location;

winding the imbricated formation of printed products together with a tensioned winding band onto the rotating hollow substantially cylindrical winding core with one of the flat sides of each printed product facing the rotating hollow substantially cylindrical winding core in order to form a wound product package thereon;

rolling each such formed wound product package in succession out of the winding location in a predetermined rolling direction upon a roll track onto a transport element in a storage unit arranged neighboring the winding location and capable of accommodating a plurality of the formed wound product packages for intermediate storage and further processing;

during said step of rolling said wound product packages, supporting said wound product packages with their circumference upon said roll track;

and displacing the transport element in timed relation to the rolling step in a direction perpendicular to said rolling direction to arrange the wound packages coaxially end to end on the transport element.

2. A method of processing printed products especially newspapers, periodicals, and the like, which have been wound in an imbricated formation together with a winding band, onto a hollow substantially cylindrical winding core to form a wound product package thereon, comprising the steps of:

arranging a storage unit in the vicinity of an unwinding location;

accommodating a plurality of said wound product packages substantially coaxially end to end on a transport element in said storage unit for intermediate storage and further processing;

displacing the transport element axially with respect to the product packages to present the packages successively to a roll track, rolling packages successively out of said storage unit upon the roll track to said unwinding station for unwinding from each said wound product package the wound products together with the winding band; and during said step of rolling said plurality of wound product packages upon said roll track, supporting said plurality of wound product packages with their circumference upon said roll track.

3. An apparatus for processing printed products arriving in an imbricated formation, especially newspapers, periodicals, and the like, comprising:

a drive unit defining a winding location for mounting and driving a hollow substantially cylindrical winding core having a substantially horizontal rotational axis;

infeed means for infeeding to said winding location an imbricated formation of printed products to be wound on said winding core to form a wound product package thereon;

a supply spool for a winding band connectable with said winding core;

support means for said supply spool;

means defining a roll track for rolling away each of the wound product packages from said winding location in a predetermined rolling direction;

said roll track supporting said wound product packages at their circumference during the rolling-away operation; and a storage unit arranged adjacent to said winding location downstream of the roll track for accommodating a plurality of said wound product packages and connected to said winding location by means of said roll track, the storage unit including support means for supporting the product packages on their circumference and means for displacing the support means in a direction perpendicular to the specified rolling direction in timed relation to the arrival of the packages so as to arrange the packages coaxially end to end on the support means.

4. The apparatus as defined in claim 3, further including:

releasable blocking means provided for said support structure for positionally arresting the wound product packages which are supported at their circumference.

5. The apparatus as defined in claim 3, further including:

support means provided at said winding location for supporting the winding core;

said support means comprising two substantially axially aligned support elements;

said two support elements defining a common substantially horizontally extending axis; and means for adjustably displacing said two support elements towards and away from one another in the direction of said common substantially horizontally extending axis.

6. An apparatus for processing printed products, especially newspapers, periodicals, and the like, wound in imbricated formation together with a winding band upon a hollow substantially cylindrical winding core to form a wound product package defining a rotational axis, comprising:

support means defining an unwinding location for supporting each wound product package from which there are to be unwound the printed products with the wound product package having a substantially horizontal axis;

drive means for mounting and driving a take-up spool for a winding band which is to be unwound from said wound product package;

a drive unit for supporting and rotatably driving said take-up spool for said winding band;

outfeed means for outfeeding said imbricated formation unwound together with said winding band from said wound product packages;

a storage unit arranged adjacent to said unwinding location for accommodating a plurality of said wound product packages;

means defining a roll track connecting said storage unit with said unwinding location for rolling each of the wound product packages from said storage unit to said unwinding location in a predetermined rolling direction;

said roll track supporting said wound packages at their circumference during the rolling operation said storage unit being arranged upstream of said roll track and including further support means for supporting the product packages on their circumferences.

7. The apparatus as defined in claim 6, further including:

releasable blocking means provided for said storage unit for positionally arresting said plurality of wound product packages thereon supported at their circumference.

8. The apparatus as defined in claim 6, wherein:

said support means defining said unwinding location comprises two mutually axially aligned support elements;

said two support elements defining a common substantially horizontally extending axis; and means for displacing said two support elements towards and away from one another in the direction of their common substantially horizontally extending axis.

* * * * *